US005316471A

United States Patent [19]

Nell

[11] Patent Number: 5,316,471

[45] Date of Patent: May 31, 1994

[54] METHOD AND APPARATUS FOR MASS TRANSFER IN MULTIPLE HEARTH FUNACES

[76] Inventor: David J. Nell, 880 Lotus Ave., Oradell, N.J. 07649

[21] Appl. No.: 17,850

[22] Filed: Feb. 16, 1993

[51] Int. Cl.[5] ..... F27B 9/00

[52] U.S. Cl. ..... 432/139; 75/629; 110/225; 266/176; 266/177; 423/460; 423/461; 502/55

[58] Field of Search ..... 110/225, 346; 432/139; 75/629; 266/173, 176, 177; 423/460, 461; 502/55

[56] References Cited

U.S. PATENT DOCUMENTS

| | | | |
|---|---|---|---|
| 488,797 | 12/1892 | Pearce . | |
| 506,511 | 10/1893 | Keller . | |
| 519,317 | 5/1894 | Brown . | |
| 534,160 | 2/1895 | Keller et al. . | |
| 653,202 | 7/1900 | Argall . | |
| 797,003 | 8/1905 | Holthoff . | |
| 837,576 | 12/1906 | Leggo . | |
| 1,549,379 | 8/1925 | Pike . | |
| 1,599,467 | 9/1926 | Graves . | |
| 1,758,805 | 5/1930 | Ridge . | |
| 1,810,562 | 6/1931 | Hartley et al. . | |
| 1,825,947 | 10/1931 | Fowler et al. | 432/139 |
| 1,825,947 | 10/1931 | Fowler et al. . | |
| 2,232,556 | 2/1941 | Nichols | 110/13 |
| 2,345,497 | 3/1944 | Owen | 110/18 |
| 2,349,755 | 5/1944 | Prather | 110/75 |
| 2,457,587 | 12/1948 | McIlvaine | 22/89 |
| 2,483,918 | 10/1949 | Martin | 110/8 |
| 2,505,363 | 4/1950 | Nichols | 110/15 |
| 2,710,182 | 6/1955 | Shelton | 266/21 |
| 3,671,167 | 5/1972 | Nakano | 431/190 |
| 3,740,184 | 6/1973 | Oleszko | 432/235 |
| 3,788,800 | 1/1974 | Middleton et al. | 432/235 |
| 3,905,757 | 9/1975 | von Dreusche, Jr. | 432/18 |
| 3,962,128 | 6/1976 | Nelson et al. | 252/421 |
| 4,227,873 | 10/1980 | Manshausen et al. | 432/131 |
| 4,347,156 | 8/1982 | Lombana et al. | 110/225 X |
| 4,391,208 | 7/1983 | Lewis | 110/346 |
| 4,906,183 | 3/1990 | Kyffin et al. | 432/138 |

*Primary Examiner*—Edward G. Favors
*Attorney, Agent, or Firm*—Webb Ziesenheim Bruening Logsdon Orkin & Hanson

[57] ABSTRACT

An apparatus for improving mass transfer in a multiple hearth furnace has a plurality of risers adjacent the furnace center shaft which are in fluid communication with a source of treatment fluid. The risers have radially extending branch pipes, each pipe having a plurality of downcomers corresponding to the rabbles on an adjacent rabble arm. The downcomers have outlets or nozzles at their distal ends and they are preferably located adjacent a rear face of the rabble, near a trailing edge. In operation, as the rabbles plough over the material on the furnace hearth, the downcomers inject a treatment fluid, such as steam or reducing gas, into the material at the point of stirring. This ensures full exposure of the material to the treatment fluid. A second embodiment places the outlets beneath the top surface of the material to be treated. A method for mass transfer on a rotary hearth furnace is also disclosed.

24 Claims, 4 Drawing Sheets

METHOD AND APPARATUS FOR MASS TRANSFER IN MULTIPLE HEARTH FUNACES

BACKGROUND OF THE INVENTION

1. Field of the Invention

This invention relates to multiple hearth furnaces and, more particularly, to an improved method and apparatus for introducing gases or liquids into the furnace for purposes of mass transfer.

2. Description of the Prior Art

In many industrial processing applications, it is important to bring about heat transfer and mass transfer at the same time in order to produce the desired product. These types of processes are often carried out in multiple hearth furnaces. For example, activated carbon is produced by heating raw material (carbonaceous material) to high temperatures (1500°-2000° F.) and, while at these temperatures, oxidizing the material with steam, air and carbon dioxide to selectively remove material. This leaves the product with a large internal surface area. The reactivation of spent activated carbon is a similar process. Another example is the reduction of nickel-containing containing ores. In this process, the ores are heated to 1200°-1500° F. and reacted with reducing gases to reduce the nickel oxide in the ore to metallic nickel.

The multiple hearth furnace (MHF) is a useful heat transfer device at the high temperatures required, but contact between the solids and fluids is not satisfactory with present designs because there is little mixing of the same. With vertically arranged furnaces, most of the solid-fluid contact is during a limited time when solids drop from hearth to hearth. The prior art in this regard is discussed in U.S. Pat. No. 5,080,025. In some designs, particularly rotary hearth furnaces, a multiplicity of nozzles or other inlets have been affixed to the furnace shell and jets of gases or other fluids are passed through these nozzles over the bed of solids. Such arrangements may be seen in U.S. Pat. Nos. 506,511; 4,227,873 and 4,391,208. This method provides little mixing of solids and gases. Most of the gases pass over the bed of solids and there is only localized reaction at the surface of the bed. This localized reaction can result in operational problems, such as nonuniform product.

U.S. Pat. Nos. 534,160; 1,825,947; 2,505,363; and 3,671,167 disclose multiple hearth furnaces having apertures in the rabble arms for feeding air into the furnace. However, it would be impractical to pass certain treatment fluids, such as steam, directly through the rabble arms of these designs. The rabble arms are typically fed directly from the hollow center shaft of the furnace. Center shafts and arms are almost uniformly built from cast iron, which would rust if used to convey steam or other corrosive treatment fluids. Additionally, the primary purpose for passing fluids through rabble arms to date has been to cool the arms. Problems and objectives related to improving mass transfer in the furnace have not been addressed. Furthermore, the designs in the above patents fall short of providing the intimate mixing of solids and gases found desirable in the aforementioned processes.

U.S. Pat. No. 488,797 discloses a roasting furnace having rabble arms which also serve as feed pipes for tubes U. Tubes U extend downward behind the rabbles to supply air for oxidizing purposes in the process of calcination. Again, this arm-fed design would not be suitable for conveying steam or corrosive fluids. Additionally, the tubes U are not optimally located for providing maximum solid-gas contact. U.S. Pat. No. 4,906,183 discloses a rotary hearth kiln 10 having a manifold pipe 76 with depending air nozzles 78 to blow materials, such as slate, off a hearth 12 into a receiver 88. The air nozzles 78 are said to aid in temperature reduction of the material under treatment, but they are not designed and placed to accomplish both heat transfer and mass transfer as provided by the present invention.

Therefore, it is an object of the present invention to substantially improve mass transfer in multiple hearth furnaces between fluids and solids in processes such as manufacturing activated carbon, reactivating spent activated carbon and reducing nickel ore to metallic nickel.

SUMMARY OF THE INVENTION

Briefly, according to this invention, there is provided an apparatus for mass transfer in hearth-type furnaces which have a center shaft with a plurality of radially extending arms. The arms extend over a hearth on which a material to be treated is conveyed generally in a radial direction (outwardly or inwardly) on the hearth by a plurality of rabbles on the arms.

The apparatus comprises at least one riser parallel with the center shaft. The riser is in communication with a source of treatment fluid, such as steam or reducing gases. At least one branch pipe radially extends from the riser. The branch pipe is discrete from and extends parallel to one of the rabble arms. Hangers secure the riser and the branch pipes to the center shaft and rabble arms.

A plurality of downcomers extend from each branch pipe in the direction of the hearth. Each downcomer has an outlet located adjacent one of the rabbles. The downcomers define conduits for injecting the treatment fluid into the material when the material is ploughed over by the rabble.

The apparatus may further include a rotary joint which maintains fluid communication between the riser and the fluid source, while allowing the riser to rotate with respect to a longitudinal axis of the center shaft.

In a preferred embodiment, each rabble includes a front face, a rear face, a leading edge and a trailing edge. The outlet on each downcomer is preferably located adjacent the rear face of a rabble near the trailing edge. This has been found to be the optimal location for introducing the treatment fluid to the solid and maximizing solid-fluid contact. In a further preferred embodiment, the outlet is located on the downcomer such that when the material being treated on the hearth forms a layer with a top surface the outlet is located below the top surface to inject treatment fluid into the material below the surface.

The invention also includes a method for treating a material to effect mass transfer in the above-described apparatus.

DETAILED DESCRIPTION OF THE PREFERRED EMBODIMENTS

Figure 1:
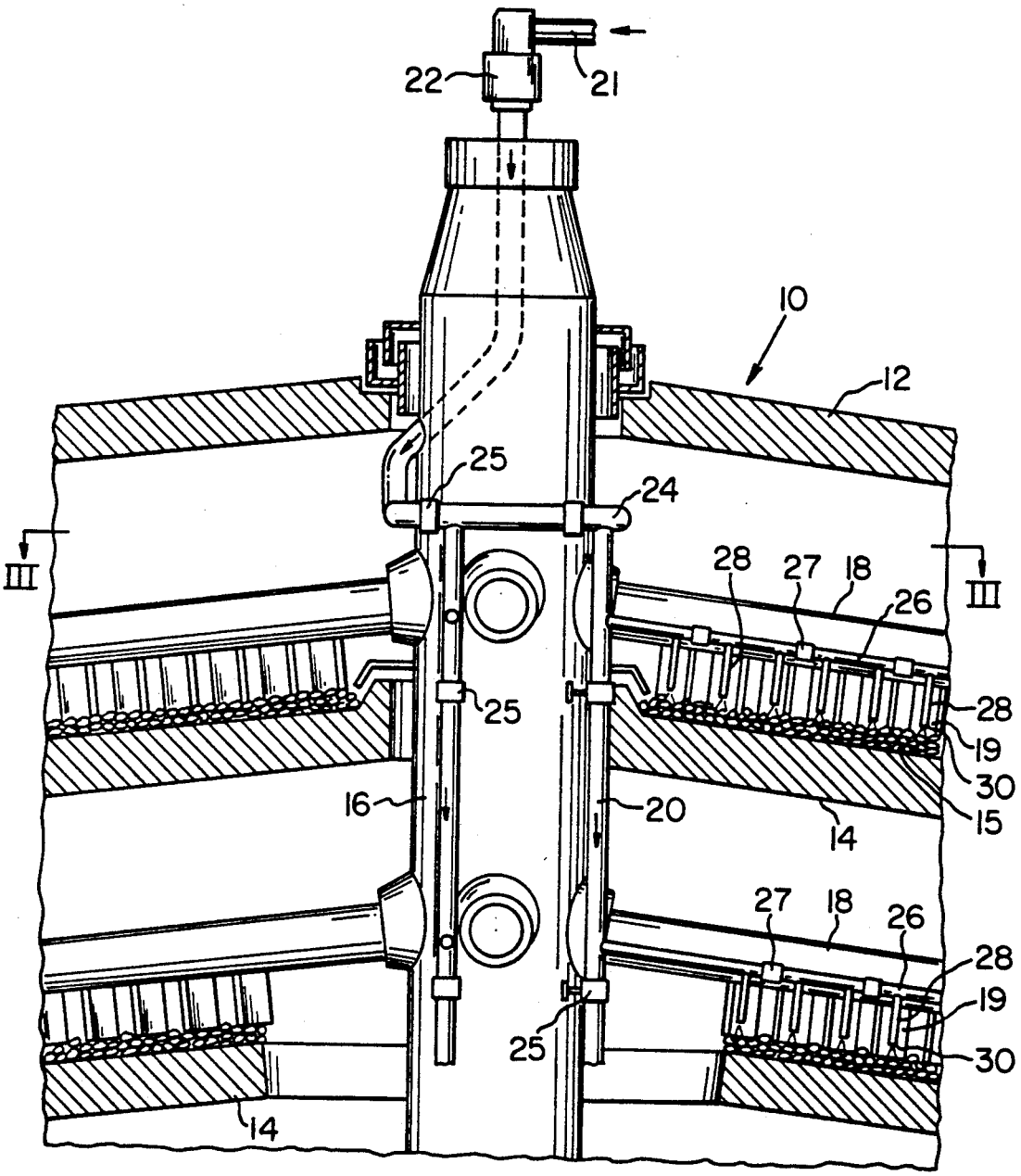
FIG. 1 is an elevation in partial section of a multiple hearth furnace having an apparatus according to the invention.
Figure 3:
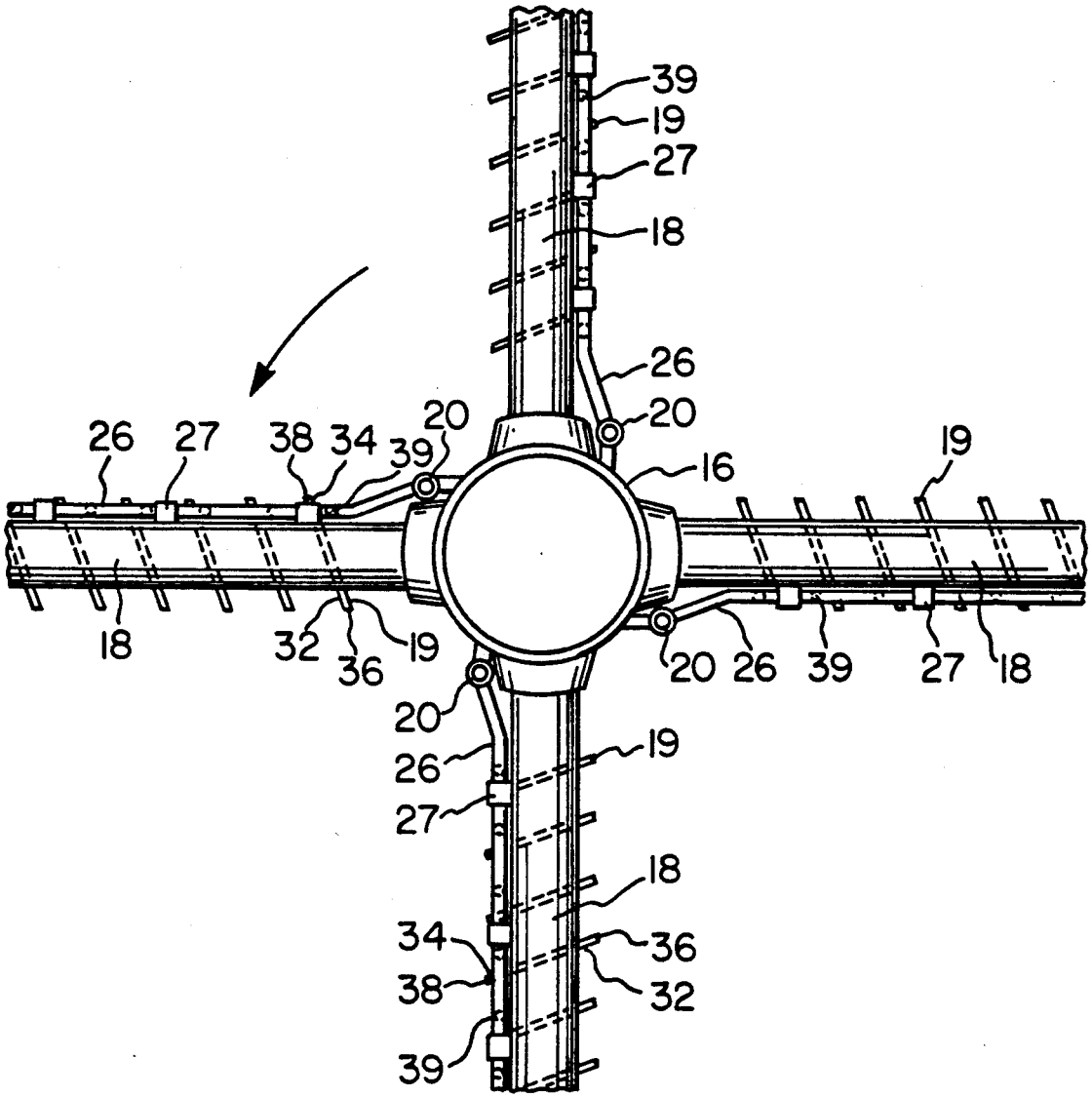
FIG. 3 is a sectional view taken along lines III—III of FIG. 1.

A multiple hearth furnace (MHF) 10 according to a first embodiment of the present invention is shown in FIGS. 1 and 3. The MHF 10 includes a steel, refractory-lined cylindrical body 12 enclosing a plurality of hearths 14. Hearths 14 have alternating inner and outer openings, as known in the art. A hollow rotatable shaft 16 extends upwardly through the center of the furnace 10 and the hearths are generally concentric therewith. A material 15 to be treated is charged on the hearths 14.

Affixed to the shaft 16 immediately above each of the hearths 14 are a plurality of rabble arms 18. Each arm carries a plurality of rabbles 19 which impart a ploughing action on material 15 upon relative rotation of the arms 18 and hearths. Shaft and arms affixed thereto are rotatably driven by a motor and gear arrangement (not shown) . The furnace contains a suitable opening through which material 15 to be treated is introduced and charged on the upper surface of hearths 14. Another opening will be located at the bottom of the furnace through which treated material and/or byproducts are removed from the furnace. Suitable means for exhausting gases from the furnace are also included. Further details of a MHF with which the invention may be practiced may be seen in U.S. Pat. No. 5,080,025, incorporated by reference herein.

According to a preferred embodiment of the invention, a plurality of risers 20 are affixed to and rotate with the center shaft 16. The risers are in fluid communication with a source (generally designated at inlet 21) of pressurized treatment fluid, such as steam or reducing gas. A rotary joint 22 enables the risers 20 to be rotated with the center shaft 16, while maintaining fluid communication with the treatment fluid source. Particularly, the rotary joint must be capable of operation while passing fluids at higher than ambient temperature, such as steam. Rotary joints (rotating connectors) are commercially available. The risers 20 extend from a header (manifold) 24 which encircles shaft 16. Hangers 25 affix the header 24 and risers 20 to shaft 16. Alternatively, the header and risers may be supported independent of the shaft 16. Each riser 20 has a plurality of branch pipes 26 corresponding to rabble arms 18 and extending radially outward from the riser. Branch pipes 26 are separate and apart from the arms 18, extend parallel with the arms and are generally coterminous therewith. Hangers 27 secure the branch pipes 26 to their respective arms 18. The risers 20 and branch pipes 26 are generally of a smaller diameter than the shaft 16 and arms 18 for ease of supplying the treatment fluid to the hearth material at the pressures and velocities required. Risers 20 and pipes 26 are preferably stainless steel. Additionally, since the riser and branch pipe system does not generally bear the stress and strain of moving the materials across the hearths, the overall integrity of the fluid delivery system is higher than would otherwise exist in a system where the fluid is delivered directly through the center shaft and arms.

Extending downward toward the hearth 14 from each branch pipe 26 are a plurality of downcomers 28. Each downcomer has an outlet 30 at its distal end. The treatment fluid is issued from outlets 30, as described in further detail below. The ploughing action of the rabbles 19 against the material 15 conveys the materials either outward or inward on the hearth 14 in a spiral fashion. This movement is caused by relative rotation of the arms and center shaft with respect to hearths 14.

Figure 2:
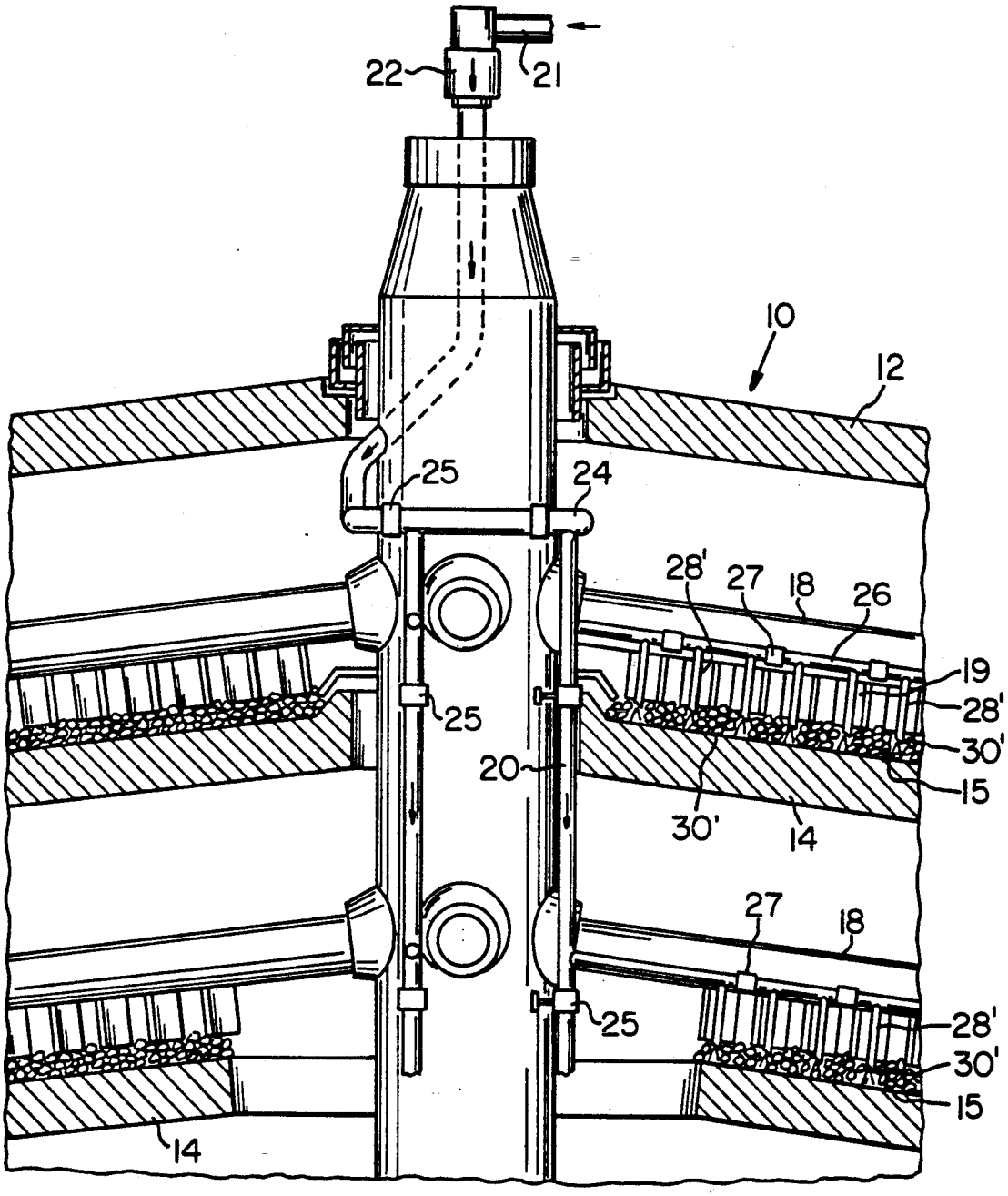
FIG. 2 is an elevation in partial section showing a second embodiment of the invention.
Figure 4:
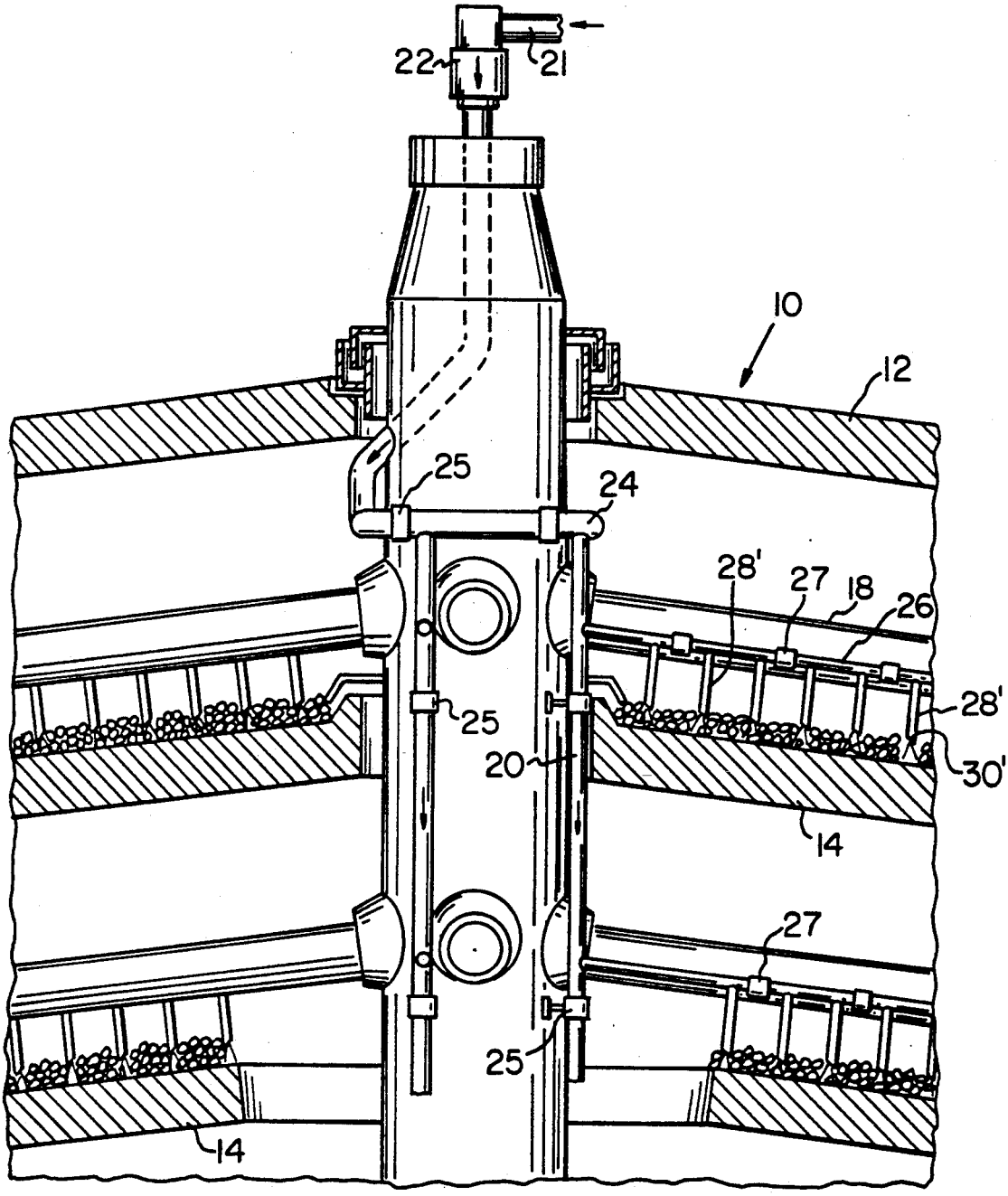
FIG. 4 is an elevation in partial section showing a third embodiment of the invention.

Referring to FIG. 3, each rabble 19 has a front face 32, a rear face 34, a leading edge 36 and a trailing edge 38. Each downcomer 28 is disposed on a side of a rabble 19 with which it is associated adjacent the rear face 34. Furthermore, the downcomer 28 is placed near trailing edge 38 of the rabble 19. This has been found to be the optimal location for injecting the material 15 with the treatment fluid. Particularly, this location ensures that the material is injected at the point where it is being ploughed over by the respective rabble 19 so that the material on the hearth 14 is more fully exposed to the treatment fluid throughout its depth. This prevents the formation of scales on the top surface of the material and reduces the occurrence of nonuniform product. Furthermore, outlets 30 may be cut away in an angled fashion, as shown in FIGS. 2 and 4, to reduce the abrading effect of the injected treatment fluid on more frangible charge materials, such as carbon. To further promote even distribution of treatment fluid, orifices 39 are drilled in branch pipes 26, which are substantially smaller than the diameter of downcomers 28. For example, the orifices may be ¼-inch in diameter as compared to a one (1) inch downcomer internal diameter. Thus, the treatment fluid experiences a velocity reduction on entering downcomers 28 from pipes 26, and an abrading effect on material 15 is avoided.

Examples utilizing a prototype of the present invention are set forth below. The invention is particularly applicable to processes for manufacturing activated carbon, reactivating spent activated carbon and reducing nickel ore to metallic nickel. A further application for the invention is in processing organic sludges. These sludges are pyrolyzed or charred and the residual carbon activated by steam injection. This activated char serves to immobilize heavy metals present in the sludge. It also provides desirable properties to the char when used as fertilizer.

FIG. 2 shows a second embodiment of the invention wherein downcomers 28' are further extended below a top surface 40 of material 15 to ensure that outlets 30' are submerged within material 15. Downcomers 28' are preferably located adjacent rear face 34 and near trailing edge 38 of their respective rabble 19, as described in connection with the first embodiment.

EXAMPLE 1 (COMPARATIVE)

Testwork on a prototype system according to the invention was carried out using a single hearth furnace with rotating rabble arms. A partially devolatized carbonaceous material was charged to the hearth and heated to 1900° F. in a neutral atmosphere. Two runs were made using a conventional manner of activating the carbon, i.e., steam was introduced into the atmosphere about the carbon. The efficacy of the treatment was measured by testing the treated material using the Iodine number procedure. The Iodine number is a measure of carbon surface area and the higher the number the higher the surface area. Generally a higher number is desirable.

| | Processing Time | $I_2$ No. |
|---|---|---|
| Test 1 | 30 min. | 500 |
| Test 2 | 60 min. | 617 |

EXAMPLE 2

Another series of tests was run using apparatus according to this invention wherein steam was introduced through downcomers penetrating 1" into the carbon bed behind rabbles. Each downcomer was located at the trailing edge adjacent the rear face of its respective rabble. The results were:

| | Processing Time | $I_2$ No. |
|---|---|---|
| Test 1 | 45 min. | 751 |
| Test 2 | 45 min. | 803 |

EXAMPLE 3

Another series of tests using apparatus according to this invention were made using steam jets or downcomers in place of the rabble teeth. The steam jets were fabricated from small diameter tubing and penetrated about 1" into the carbon bed, as shown in a third embodiment of the invention, FIG. 4. The injected steam fluidized the material and conveyed it radially outward in a spiral fashion. The results were as follows:

| | Processing Time | $I_2$ No. |
|---|---|---|
| Test 1 | 15 min. | 558 |
| Test 2 | 30 min. | 763 |
| Test 3 | 45 min. | 927 |

EXAMPLE 4

Experiments to activated charred granules of carbonaceous materials were carried out in a single hearth gas fired test furnace. Test A, the blank run, was carried out with steam injected into the chamber of the furnace to illustrate the conventional method of manufacturing activated carbon. Test B was carried out with steam injection nozzles placed at the same level as the bottom of the rabble teeth. Both runs used the same temperatures and steam rates. Carbon samples were removed from the test furnace at various time intervals and tested for iodine number. The iodine number test is a measure of the carbon's activity and generally an iodine number of 1000 is considered good. The results were:

| Processing Time | $I_2$ No. Test A and Test B | |
|---|---|---|
| 30 min. | | 650 |
| 40 min. | 575 | 812 |
| 50 min. | 629 | 834 |
| 60 min. | | 1001 |
| 70 min. | 666 | 1158 |
| 80 min. | | 1146 |

Thus, from Examples 1–4, it can be seen that use of the downcomers according to the invention made a dramatic difference in the quality of the carbon produced.

Besides improving production rate and carbon quality, the invention provides a way of better utilizing the steam used in the carbon reactivation process. I estimate that the steam usage approaches the theoretical requirement whereas the rate of steam addition in conventional reactivation furnaces is about six times theoretical. This has important repercussions; not only are steam requirements reduced, fuel requirements are reduced also (as there is less steam to heat up to the furnace temperatures) . This in turn means lower quantities of gases emitted from the furnace which results in more economical gas cleaning systems. In certain areas the production rate of furnaces has been restricted by governmental edicts which are based on the quantity of off-gas emitted. This invention, by lowering off-gas qualities, offers an opportunity to renegotiate these restrictions.

Having described the presently preferred embodiments of the invention, it will be understood that it is not intended to limit the invention except within the scope of the following claims.

I claim:

1. An apparatus for mass transfer in a furnace having a center shaft with a plurality of radially extending arms, said arms extending over a hearth on which a material to be treated is conveyed, said material conveyed outward or inward on said hearth by a plurality of rabbles on said arms, said apparatus comprising:
   - at least one riser parallel with said center shaft, said riser in communication with a source of treatment fluid;
   - at least one branch pipe radially extending from said riser, said branch pipe discrete from and extending along one of said arms;
   - a plurality of downcomers extending from said branch pipe in the direction of said hearth, each downcomer having an outlet thereon;
   - means for securing said riser and said branch pipe to said center shaft and said rabble arm, respectively;
   - each outlet located adjacent one of said rabbles to define means for injecting said treatment fluid into said material at such time as the material is ploughed over by said rabble.

2. The apparatus of claim 1 wherein said hearth is stationary and said center shaft and said arms rotate with respect to said hearth.

3. The apparatus of claim 1 including a rotary joint which maintains fluid communication between said riser and said fluid source while said riser rotates with respect to a longitudinal axis of said center shaft.

4. The apparatus of claim 1 wherein each outlet is cut away.

5. The apparatus of claim 1 wherein each rabble includes a front face, a rear face, a leading edge and a trailing edge, each outlet located adjacent the rear face and near the trailing edge of its respective rabble.

6. The apparatus of claim 1 wherein the material to be treated defines a top surface, said outlet located below said top surface to inject treatment fluid into said material.

7. The apparatus of claim 1 including a plurality of orifices in said branch pipe, each orifice corresponding to one of said downcomers, said orifice having a smaller diameter than an internal diameter of its respective downcomer.

8. A method for treating a material to effect mass transfer on a hearth in a furnace, said method comprising the steps of:
   - (a) charging said material on said hearth;
   - (b) moving said material outward or inward on said hearth with a plurality of rabbles engaging said material due to relative rotation between said hearth and said rabbles;
   - (c) passing a treatment fluid into said furnace via a discrete piping system including at least one riser and at least one branch pipe; and (d) injecting said treatment fluid through a downcomer in communication with said branch pipe and adjacent each rabble, said material injected with said treatment fluid when it is ploughed over by said rabble.

9. The method of claim 8 wherein said rabble has a front face, a rear face, a leading edge and a trailing edge and step (d) includes injecting said treatment fluid at said trailing edge.

10. The method of claim 9 wherein step (d) includes injecting said treatment fluid at said rear face.

11. The method of claim 8 wherein said material to be treated is carbonaceous.

12. The method of claim 8 wherein said material to be treated is spent activated carbon.

13. The method of claim 8 wherein the treatment fluid is steam.

14. The method of claim 8 wherein the material to be treated is nickel ore.

15. The method of claim 8 wherein the material to be treated is organic sludge.

16. The method of claim 8 wherein the treatment fluid is selected from the group consisting of natural gas, reformer gas, hydrogen, mineral oil and combinations thereof.

17. A method of manufacturing activated carbon or reactivating spent activated carbon, comprising the steps of:

(a) charging carbonaceous material or spent carbon on a hearth in a furnace having a center shaft with a plurality of radially extending arms, said arms and center shaft rotating with respect to said hearth;

(b) passing steam into said furnace through a discrete piping system including at least one riser parallel to said center shaft and at least one branch pipe extending radially outward from said riser, said branch pipe corresponding to one of said arms;

(c) rotating said riser and branch pipe about an axis concentric with said center shaft; and (d) injecting said carbonaceous material or spent carbon with steam through a plurality of downcomers extending from said branch pipe toward said hearth.

18. The method of claim 17 including the step of passing said steam through an orifice in said branch pipe prior to entering said downcomer, said orifice in direct communication with said downcomer and having a diameter smaller than an internal diameter of said downcomer.

19. The method of claim 17 wherein step (d) includes fluidizing said material on said hearth with the injected steam and moving the material with the action of injected steam radially outward or inward on said hearth.

20. The method of claim 17 wherein step (d) includes injecting said steam into said material on the hearth below a top surface of the material.

21. A method of reducing nickel containing ores, comprising the steps of:

(a) charging nickel containing ore on a hearth in a furnace having a center shaft with a plurality of radially extending arms, said arms and center shaft rotating with respect to said hearth;

(b) passing reducing gases into said furnace through a discrete piping system including at least one riser parallel to said center shaft and at least one branch pipe extending radially outward from said riser, said branch pipe corresponding to one of said arms;

(c) rotating said riser and branch pipe about an axis concentric with said center shaft; and (d) injecting said nickel containing ore with reducing gases through a plurality of downcomers extending from said branch pipe toward said hearth.

22. The method of claim 21 including the step of passing said gases through an orifice in said branch pipe prior to entering said downcomer, said orifice in direct communication with said downcomer and having a diameter smaller than an internal diameter of said downcomer.

23. The method of claim 21 wherein step (d) includes fluidizing said material on said hearth with the injected gases and moving the material with the action of injected gases radially outward or inward on said hearth.

24. The method of claim 21 wherein step (d) includes injecting said gases into said material on the hearth below a top surface of the material.

* * * * *